US008814586B2

(12) United States Patent
Ishikawa et al.

(10) Patent No.: US 8,814,586 B2
(45) Date of Patent: Aug. 26, 2014

(54) CONNECTOR

(75) Inventors: Shigeki Ishikawa, Kanagawa (JP); Noritoshi Takamura, Kanagawa (JP); Makoto Saito, Kanagawa (JP); Michiya Masuda, Kanagawa (JP)

(73) Assignee: NHK Spring Co., Ltd., Yokohama-shi (JP)

( * ) Notice: Subject to any disclaimer, the term of this patent is extended or adjusted under 35 U.S.C. 154(b) by 51 days.

(21) Appl. No.: 13/636,074

(22) PCT Filed: Mar. 23, 2011

(86) PCT No.: PCT/JP2011/057036

§ 371 (c)(1),
(2), (4) Date: Sep. 19, 2012

(87) PCT Pub. No.: WO2011/118656

PCT Pub. Date: Sep. 29, 2011

(65) Prior Publication Data

US 2013/0012047 A1 Jan. 10, 2013

(30) Foreign Application Priority Data

Mar. 24, 2010 (JP) ..... 2010-068699

(51) Int. Cl.
*H01R 13/15* (2006.01)

(52) U.S. Cl.
USPC ..... 439/263; 439/265; 439/268

(58) Field of Classification Search
USPC ..... 439/263, 265, 259, 261, 266, 268
See application file for complete search history.

(56) References Cited

U.S. PATENT DOCUMENTS

| | | | | | |
|---|---|---|---|---|---|
| 2,427,001 | A | * | 9/1947 | Hubbell et al. | 439/731 |
| 2,997,681 | A | * | 8/1961 | Klassen | 439/268 |
| 3,295,872 | A | * | 1/1967 | Kragle | 403/350 |
| 3,364,302 | A | * | 1/1968 | Slick | 174/75 R |
| 3,380,017 | A | * | 4/1968 | Gomulka | 439/718 |
| 3,518,614 | A | * | 6/1970 | Nyberg | 439/268 |
| 3,559,155 | A | * | 1/1971 | Frey | 39/268 |
| 4,082,399 | A | * | 4/1978 | Barkhuff | 439/264 |
| 4,192,567 | A | * | 3/1980 | Gomolka | 439/320 |
| 5,154,626 | A | * | 10/1992 | Watson | 439/268 |

(Continued)

FOREIGN PATENT DOCUMENTS

| | | |
|---|---|---|
| JP | 59-25189 U | 2/1984 |
| JP | 64-043979 A | 2/1989 |

(Continued)

OTHER PUBLICATIONS

International Search Report dated Apr. 19, 2011, issued for PCT/JP2011/057036.

*Primary Examiner* — Ross Gushi
(74) *Attorney, Agent, or Firm* — Edwards Wildman Palmer LLP

(57) ABSTRACT

A connector that includes a male terminal which has a conductive property and a tip portion of which is formed in a bar shape, and includes a coil spring formed of a conductive wire rod with an inner diameter smaller than a diameter of the tip portion of the male terminal and that linearly extends at an end portion at which the male terminal is inserted. The male terminal is inserted into the coil spring while a force that expands an inner diameter of at least a vicinity of the end portion is applied to an extending portion, and thereafter fitted to the coil spring by releasing the force.

5 Claims, 8 Drawing Sheets

(56) References Cited

U.S. PATENT DOCUMENTS

| | | | | |
|---|---|---|---|---|
| 5,439,393 | A * | 8/1995 | Watson | 439/578 |
| 5,628,644 | A * | 5/1997 | Szalay et al. | 439/263 |
| 5,906,520 | A * | 5/1999 | Frinker et al. | 439/841 |
| 6,206,736 | B1 * | 3/2001 | DeFrance et al. | 439/796 |
| 6,341,973 | B1 | 1/2002 | Endo | |
| 6,589,063 | B2 * | 7/2003 | Kamo et al. | 439/268 |
| 7,278,753 | B2 * | 10/2007 | Uke | 362/206 |
| 7,429,199 | B2 * | 9/2008 | Burgess | 439/841 |
| 7,547,215 | B1 * | 6/2009 | Mark et al. | 439/66 |
| 7,874,880 | B2 * | 1/2011 | Fedde et al. | 439/841 |
| 7,901,233 | B2 * | 3/2011 | Melni | 439/271 |

FOREIGN PATENT DOCUMENTS

| | | | |
|---|---|---|---|
| JP | 1-155680 | U | 10/1989 |
| JP | 5-53012 | U | 7/1993 |
| JP | 06-132043 | A | 5/1994 |
| JP | 08-031513 | A | 2/1996 |
| JP | 2001-160459 | A | 6/2001 |

* cited by examiner

CONNECTOR

FIELD

The present invention relates to a connector including a male terminal and a female terminal that are fitted and connected to each other.

BACKGROUND

Conventionally, to connect electronic devices installed inside an automobile or the like, a connector is used that causes a male terminal and a female terminal to be fitted to each other to connect the devices via wires or the like. In the connector including the male terminal and the female terminal, the male terminal and the female terminal can be fitted to each other and electrical connection is enabled by bringing lead wires or electrodes in the terminals into contact with each other.

Meanwhile, in the connector described above, it is necessary to maintain the fitted state of the male terminal and the female terminal in order to continue the electrical connection between the electronic devices. In particular, for use as a connector to be mounted on a product, such as an automobile, that is likely to vibrate, there is a demand for a connector that can maintain the fitted state to prevent the male terminal and the female terminal from being disconnected due to the vibration.

As a connector that meets the demand, for example, there is a known connector that locks the male terminal and the female terminal by engaging a locking arm, a locking projection, and a locking surface while an elastic force is applied by an elastic body (see, for example, Patent Literature 1). Furthermore, there is a known connector that locks the male terminal and the female terminal by locking an engagement protrusion of a locking arm, to which an elastic force is applied by a repulsion spring, and an arm locking portion (see, for example, Patent Literature 2).

CITATION LIST

Patent Literature

Patent Literature 1: Japanese Patent Application Laid-open No. 8-031513

Patent Literature 2: Japanese Patent Application Laid-open No. 2001-160459

SUMMARY

Technical Problem

However, in the conventional connectors disclosed in Patent Literatures 1 and 2, the fitted state of the male terminal and the female terminal may be released due to the action of the elastic body or due to the elastic force of the arm depending on a force applied in a direction in which the fitted state of the terminals is released.

The present invention has been made in view of the above, and an object thereof is to provide a connector capable of maintaining the fitted state of a male terminal and a female terminal with a simple structure.

Solution to Problem

To solve the problem described above and achieve the object, a connector according to the present invention is interposed between two connection objects to enable electrical continuity between the connection objects, the connector including: a male terminal which has a conductive property and a tip of which is formed in a bar shape; and a female terminal formed of a conductive wire rod that is wound with an inner diameter smaller than a diameter of the male terminal, the wire rod linearly extending at an end portion of the female terminal at which the male terminal is to be inserted, wherein the male terminal is inserted into the female terminal while a force that expands an inner diameter of at least a vicinity of the end portion is applied to the linearly extending portion, and thereafter fitted to the female terminal by releasing the force.

In the connector according to the present invention as set forth in the invention described above, at least a vicinity of another end portion of the female terminal is tightly wound.

In the connector according to the present invention as set forth in the invention described above, a male terminal bracket that holds the male terminal; and a female terminal bracket that holds the female terminal and that is connectable to the male terminal bracket are further provided, wherein the male terminal bracket includes a diameter expanding unit that expands a diameter of at least the linearly extending portion of the female terminal along with insertion of the male terminal into the female terminal.

In the connector according to the present invention as set forth in the invention described above, an end portion of the female terminal, the end portion being different from the linearly extending portion, is fixed to the female terminal bracket.

In the connector according to the present invention as set forth in the invention described above, the female terminal bracket includes a diameter changing unit that holds the linearly extending portion of the female terminal and moves the linearly extending portion on a plane orthogonal to a longitudinal direction of the female terminal to thereby expand the diameter of the female terminal.

In the connector according to the present invention as set forth in the invention described above, the male terminal bracket includes a guide pin that extends parallel to the male terminal and that protrudes from a tip of the male terminal in an extending direction, and the female terminal bracket includes a hole in which the guide pin is insertable.

Advantageous Effects of Invention

The connector according to the present invention expands the diameter of the coil spring whose diameter in the natural state is smaller than the diameter of the male terminal, inserts the male terminal into the coil spring with the expanded diameter, and returns the coil spring to the natural state to tighten and lock the male terminal. Therefore, it is possible to maintain the fitted state of the male terminal and the female terminal with a simple structure.

DESCRIPTION OF EMBODIMENTS

Exemplary embodiments of the present invention will be explained in detail below with reference to the drawings. The present invention is not limited by the embodiments below. Each drawing referred to in the following explanation only schematically illustrates the shape, the size, and the positional relationship to be able to understand the content of the present invention, and therefore, the present invention is not limited to only the shape, the size, and the positional relationship illustrated in each drawing.

(First Embodiment)

Figure 1:
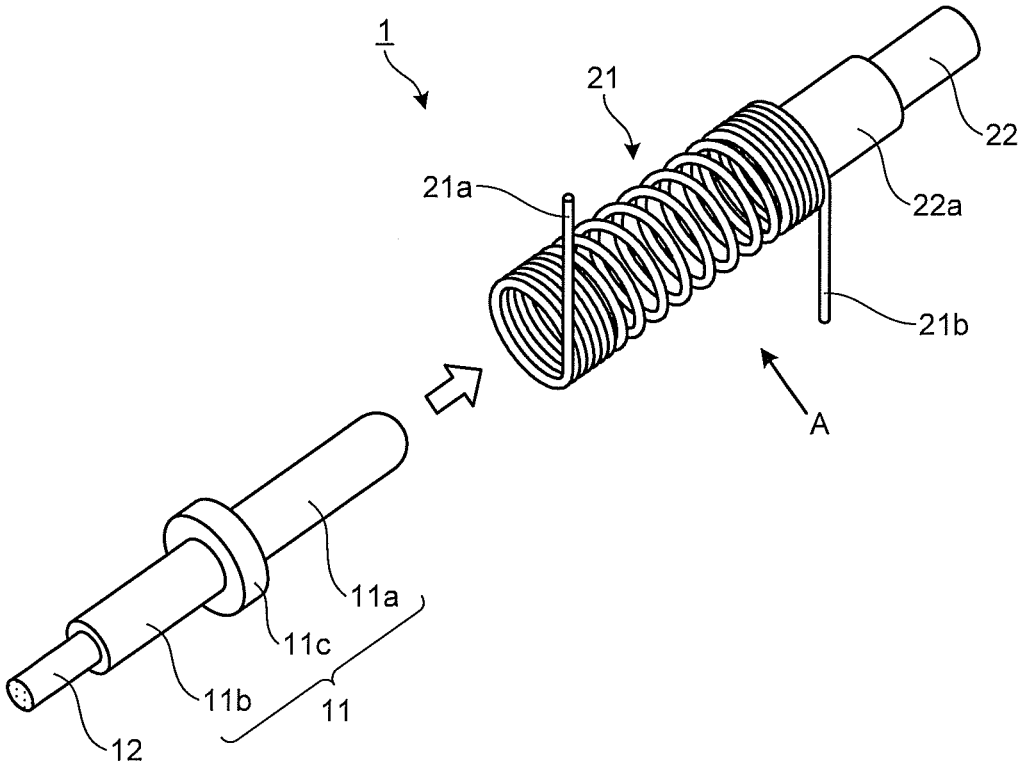
FIG. 1 is a perspective view illustrating a configuration of a connector according to a first embodiment of the present invention.

FIG. 1 is a perspective view illustrating a configuration of a connector 1 according to a first embodiment of the present invention. The connector 1 illustrated in FIG. 1 enables electrical continuity between connection objects by causing a male terminal and a female terminal to be in contact with and connected to each other.

The connector 1 includes a male terminal 11 that is connected to a lead 12 to be connected to a connection object and that has a conductive property, and a coil spring 21 serving as a female terminal that is connected to a lead 22 to be connected to a connection object via a lead terminal 22*a* and that has a conductive property.

The male terminal 11 is made of a conductive material, and includes a tip portion 11*a* which is formed in a bar shape with an approximately spherical tip, a lead terminal 11*b* which holds the lead 12, and a flange portion 11*c* which has a diameter greater than the diameter of the tip portion 11*a*.

A wire rod of the coil spring 21 has a circular cross-section, and the coil spring is wound such that the inner diameter thereof becomes smaller than the diameter of the tip portion 11*a* of the male terminal 11. Both end portions of the coil spring 21 are tightly wound. At an end of the coil spring 21 on the side opposite the lead terminal 22*a*, a linear extending portion 21*a* is provided that extends in a direction orthogonal to the extending direction of the coil spring 21. At an end of the coil spring 21 on the lead terminal 22*a* side, a fixation portion 21*b* is provided that extends in a direction orthogonal to the extending direction of the coil spring 21. The extending portion 21*a* may be formed in an arc shape with a diameter greater than the diameter of the coil spring 21.

The coil spring 21 is formed with a wire rod which is formed of a core made of SUS or beryllium copper and outer coating made of a low-resistance copper-based metal. A clad metal material or an alloy material having appropriate elasticity or thermal resistance is also applicable.

Figure 2:
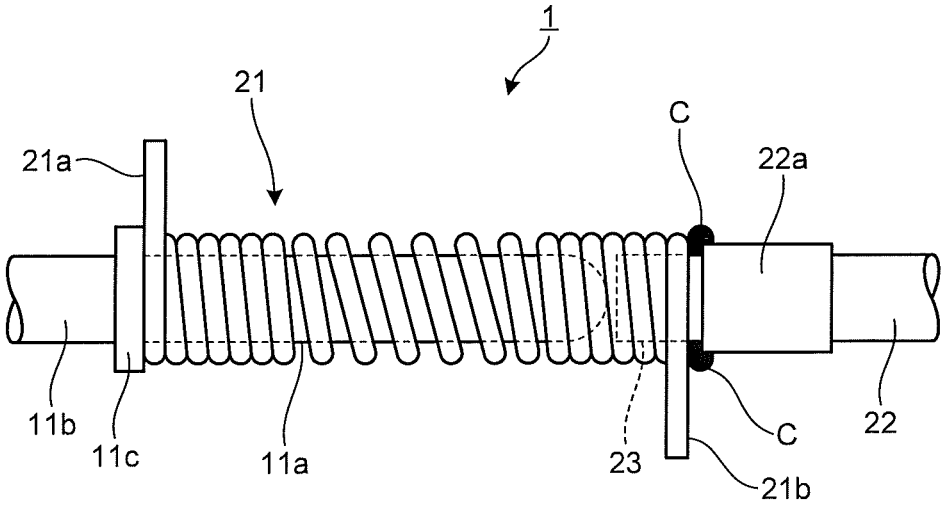
FIG. 2 is a plan view of the connector illustrated in FIG. 1 viewed in a direction of arrow A.

FIG. 2 is a plan view illustrating a state in which the male terminal 11 and the coil spring 21 are fitted to each other. When the tip portion 11*a* of the male terminal 11 is inserted into the coil spring 21, connection objects connected to the leads 12 and 22 are electrically connected. In the connector 1, the leads 12 and 22 are electrically connected via the male terminal 11 and a tightly-wound portion of the coil spring 21 on the lead 22 side, so that a signal does not flow through a loosely-wound portion. Therefore, it becomes possible to shorten a conduction pathway of electrical signals, enabling to reduce inductance and stabilize electrical continuity. The flange portion 11*c* comes in contact with the end of the coil spring 21 to thereby adjust an insertion region of the male terminal 11 in the coil spring 21.

In this case, because the inner diameter of the coil spring 21 is smaller than the diameter of the male terminal 11, the tip portion 11*a* of the male terminal 11 is tightened by a winding force of the spring, and therefore, the fitted state is maintained. Besides, the coil spring 21 is joined to a support 23, which projects from the end of the lead terminal 22*a* on the side opposite the lead 22, with the winding force of the spring and/or a solder C. To ensure the winding force of the coil spring 21 against the male terminal 11, it is preferable that the diameter of the support 23 is equal to or smaller than the diameter of the tip portion 11*a*.

Figure 3A:
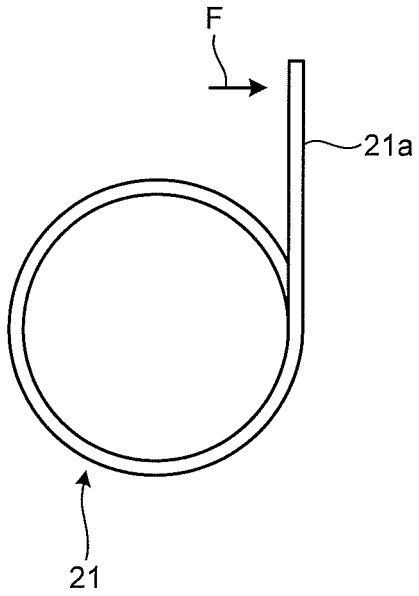
FIG. 3A is a diagram explaining an operation of a coil spring according to the first embodiment of the present invention.
Figure 3B:
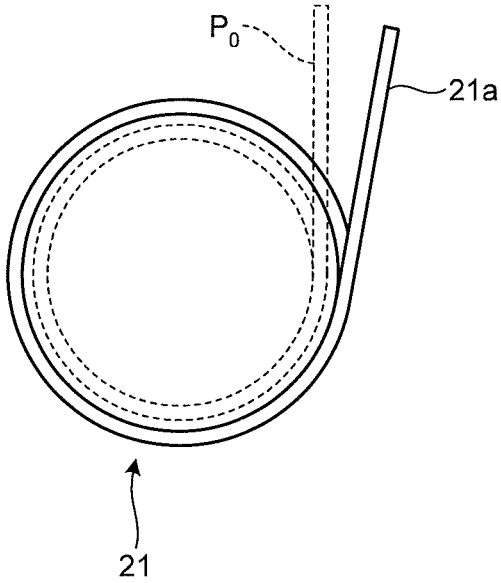
FIG. 3B is a diagram explaining an operation of the coil spring according to the first embodiment of the present invention.

FIGS. 3A and 3B are diagrams explaining an operation of the coil spring 21 when the male terminal 11 is inserted into the coil spring 21. As illustrated in FIG. 3A, a force F in a direction of arrow is applied to the extending portion 21*a* of the coil spring 21 in the natural state. In this case, it is preferable that the fixation portion 21*b* of the coil spring 21 illustrated in FIGS. 1 and 2 is fixed so as to prevent the coil spring 21 from rotating due to the force F.

With the application of the force F, the extending portion 21*a* moves to the position illustrated in FIG. 3B. A dashed line $P_0$ indicates the position of the coil spring 21 in the natural state illustrated in FIG. 3A. As described above, because the fixation portion 21*b* is fixed, the coil spring 21 does not rotate due to the force F but is elastically deformed in a direction in which the inner diameter expands.

With the operation of the coil spring 21 illustrated in FIGS. 3A and 3B, it becomes possible to insert the male terminal 11 into the coil spring 21 with the expanded inner diameter. After the male terminal 11 is inserted into the coil spring 21, if the force F applied to the extending portion 21*a* is released, the inner diameter of the coil spring 21 is reduced back to the natural state. Therefore, it is possible to tighten the male terminal 11 to maintain the fitted state.

With the connector according to the first embodiment described above, it becomes possible to maintain the fitted state of the male terminal 11 and the coil spring 21 with a simple structure. Therefore, it becomes possible to stably maintain the fitted state of the male terminal and the female terminal (the coil spring) and realize electrical continuity. Besides, when a force in a direction in which the male terminal 11 and the coil spring 21 are separated from each other is applied to the connector 1 in the fitted state, the coil spring 21 is elastically deformed in the extending direction. With this extension, the coil spring 21 is elastically deformed in a direction in which the inner diameter thereof is reduced, so that a greater winding force is applied to the male terminal 11. Therefore, it becomes possible to more reliably prevent the male terminal 11 from coming off from the coil spring 21.

While it is explained that the both terminals in the above connector are connected to the leads, it may be possible to employ a structure in which one of the terminals is connected to the lead and the other is directly connected to a substrate.

In the coil spring 21, as long as the winding force against the lead terminal 22*a* and the support 23 is ensured or as long as the connection between the coil spring 21 at the support 23 (or the lead terminal 22*a*) and the support 23 (or the lead terminal 22*a*) with the solder C is ensured, the fixation portion 21*b* may be removed. Besides, it is sufficient that at least the lead terminal 22*a* side of the coil spring 21 is tightly wound. It may be possible to tightly wind the whole coil spring 21.

Figure 4:
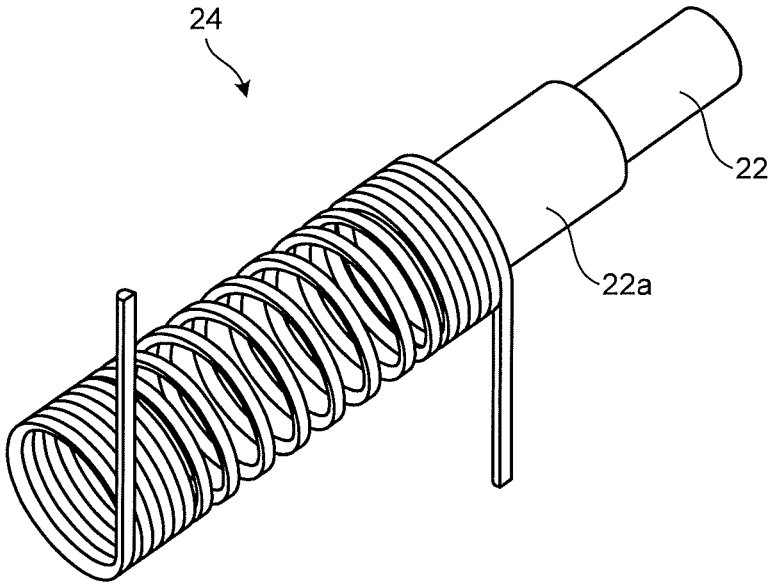
FIG. 4 is a perspective view illustrating another example of the coil spring according to the first embodiment of the present invention.
Figure 5:
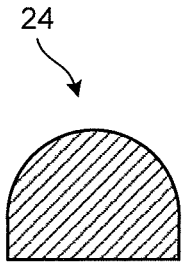
FIG. 5 is a cross-sectional view of the coil spring illustrated in FIG. 4.

FIG. 4 is a perspective view illustrating another example of the coil spring according to the first embodiment. FIG. 5 is a cross-sectional view of a coil spring 24 illustrated in FIG. 4 viewed in a direction orthogonal to a direction along which a wire rod extends. While it is explained that the wire rod of the coil spring 21 has a circular cross-section, the cross-section may be an approximate semicircle as in the coil spring 24 illustrated in FIGS. 4 and 5. However, the cross-section is not limited to the above and may be a rectangle. By increasing a contact area between adjacent wire rods, it becomes possible to reduce resistance with respect to the electrical continuity.

Figure 6:
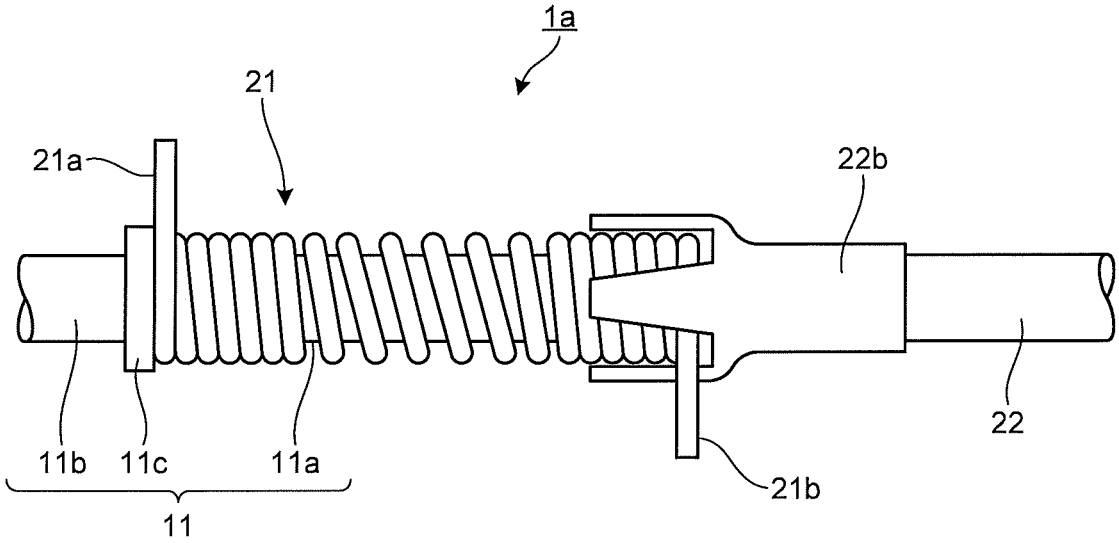
FIG. 6 is a plan view of a connector according to a first modification of the first embodiment of the present invention.

FIG. 6 is a plan view of a connector 1*a* according to a first modification of the first embodiment. The connector 1*a* illustrated in FIG. 6 includes the male terminal 11 described above, the coil spring 21 described above, and a lead terminal 22*b* having a plurality of claws. The lead terminal 22*b* is in contact with the outer periphery of the tightly-wound portion of the coil spring 21. Therefore, it becomes possible to use the integrally-molded claw portions, not the tightly-wound portion of the coil spring 21, as the conduction pathway to the male terminal 11, enabling the electrical continuity to be more stable.

It is preferable that the lead terminal 22*b* according to the first modification is formed such that the inner diameter of at least a part of a portion formed by the abovementioned claws is approximately the same or slightly smaller than the outer diameter of the coil spring 21. With the lead terminal 22*b*, because the lead terminal 22*b* is press fitted and connected to the coil spring 21, it becomes possible to reliably connect the coil spring 21 to enable electrical continuity. Furthermore, it becomes possible to connect the lead terminal 22*b* and the coil spring 21 regardless of the diameter of the coil spring 21.

Figure 7:
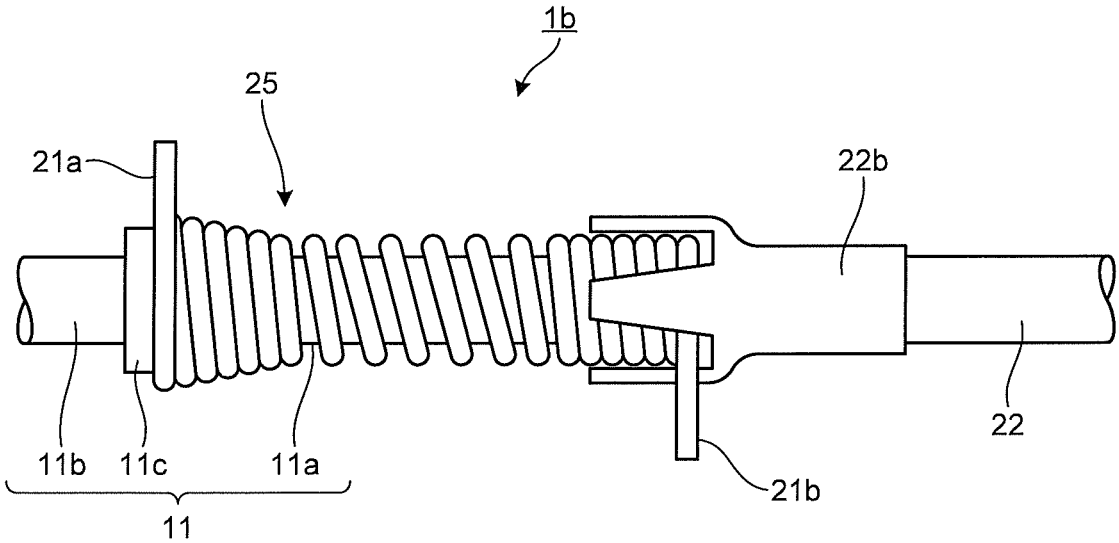
FIG. 7 is a plan view of a connector according to a second modification of the first embodiment of the present invention.

FIG. 7 is a plan view of a connector 1*b* according to a second modification of the first embodiment. The connector 1*b* illustrated in FIG. 7 includes the male terminal 11 described above, the lead terminal 22*b* described above, and a coil spring 25 whose inner diameter at the end portion on the side opposite the lead terminal 22*b* is gradually increased toward the end portion. Because the inner diameter of the portion of the coil spring 25 into which the male terminal 11 is inserted is made greater, it becomes possible to more easily insert the male terminal 11 into the coil spring 25, enabling to maintain the fitted state as described above.

(Second Embodiment)

Figure 8:
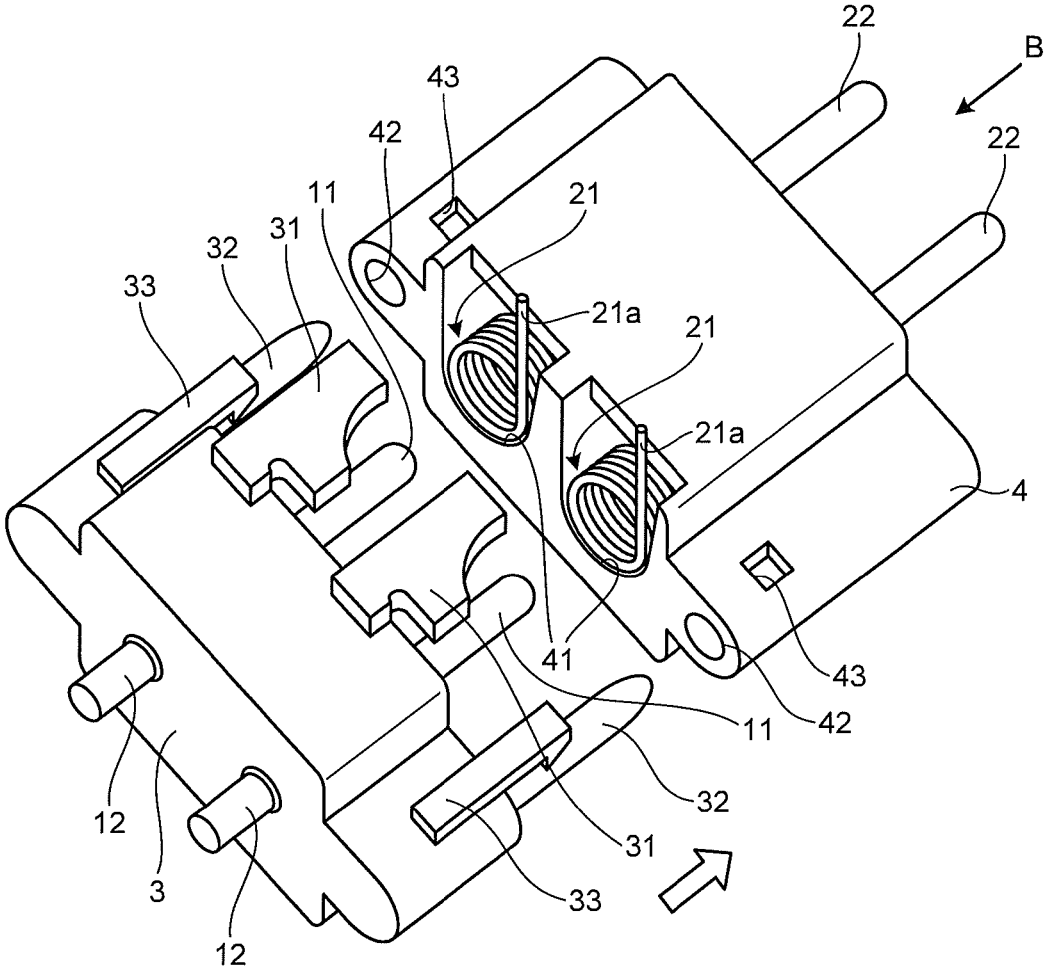
FIG. 8 is a perspective view illustrating a configuration of a connector according to a second embodiment of the present invention.
Figure 9:
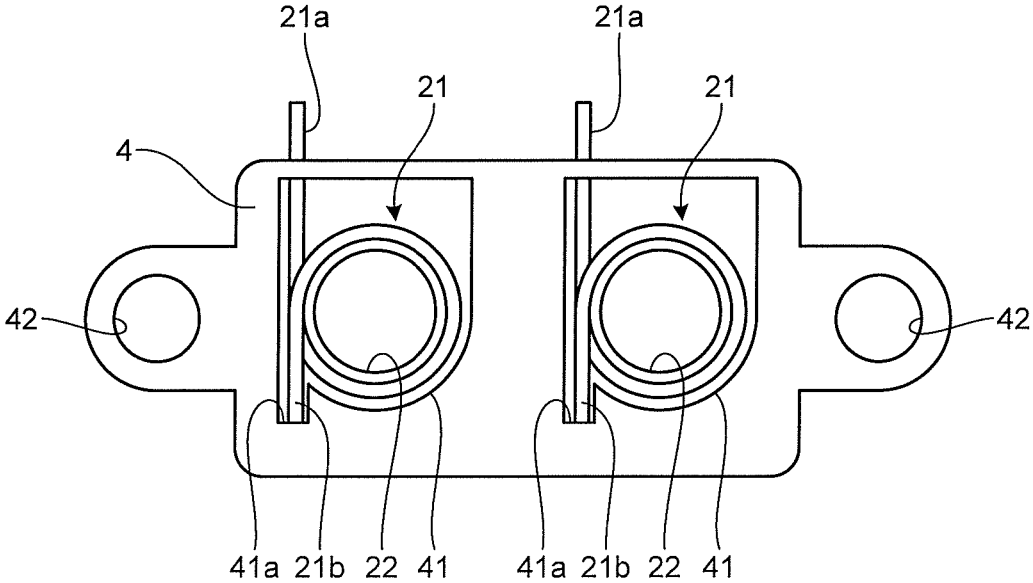
FIG. 9 is a plan view of the connector illustrated in FIG. 8 viewed in a direction of arrow B.

A second embodiment of the present invention will be explained below with reference to FIG. 8. FIG. 8 is a perspective view illustrating a configuration of a connector according to the second embodiment of the present invention. FIG. 9 is a plan view of the connector illustrated in FIG. 8 viewed in a direction of arrow B. The connector illustrated in FIGS. 8 and 9 enables electrical continuity between connection objects by causing a male terminal and a female terminal to be in contact with and connected to each other.

The connector illustrated in FIG. 8 includes a male terminal bracket 3 that holds the conductive male terminals 11 and the leads 12, and includes a female terminal bracket 4 that holds the conductive coil springs 21 serving as female terminals and the leads 22. The configurations of the male terminals 11, the leads 12, the coil springs 21, and the leads 22 are the same as those of the first embodiment described above.

The male terminal bracket 3 includes diameter expanding cams 31 as a diameter expanding means disposed on the upper portions of the male terminals 11, guide pins 32 formed in an approximately columnar shape and extending parallel to the male terminals 11 from the both ends of the male terminals 11, and lock bars 33 disposed on the upper portions of the guide pins 32, extending parallel to the guide pins 32, and having projections projecting from the tip portions thereof in a vertically downward direction with respect to the extending direction.

The diameter expanding cams 31 come into contact with the side surfaces of the extending portions 21*a* at corresponding surfaces thereof, to thereby move the extending portions 21*a* and expand the inner diameters of the coil springs 21. The diameter expanding cams 31 have notch portions (notch surfaces) that allow the extending portions 21*a* to move back to the original positions (the natural state) when the wall surface of the male terminal bracket 3 and the wall surface of the female terminal bracket 4 come in contact with each other. As for the notch portion, the diameter expanding cams 31 are disposed such that an interval between each of the notch surfaces and the wall surface of the female terminal bracket 4 becomes at least equal to or greater than the diameter of the wire rod of the coil spring 21.

The female terminal bracket 4 includes housings 41 that house the coil springs 21 and that can house even the coil springs 21 with the expanded diameters, guide holes 42 in which the guide pins 32 are inserted and maintained, and lock holes 43 as recesses to be engaged with the projections of the lock bars 33. The leads 22 are housed at predetermined positions in the female terminal bracket 4 while being in contact with the lead terminals described above, and thereafter, fixed to the female terminal bracket 4 by screwing, bonding, or fitting with use of a fixing member (not illustrated) on the end portion of the female terminal bracket 4.

As illustrated in FIG. 9, the female terminal bracket 4 also includes holding portions 41*a* that hold the fixation portions 21*b* of the coil springs 21, respectively. The holding portions 41*a* hold the fixation portions 21*b* of the coil springs 21 so as to prevent the coil springs 21 from rotating due to a force applied to the extending portions 21*a*. The holding portions 41*a* may hold the fixation portions 41*a* with fixing members, such as solders. Alternatively, the holding portions 41*a* may be provided with grooves in which the fixation portions 21*b* are inserted and maintained.

Figure 10:
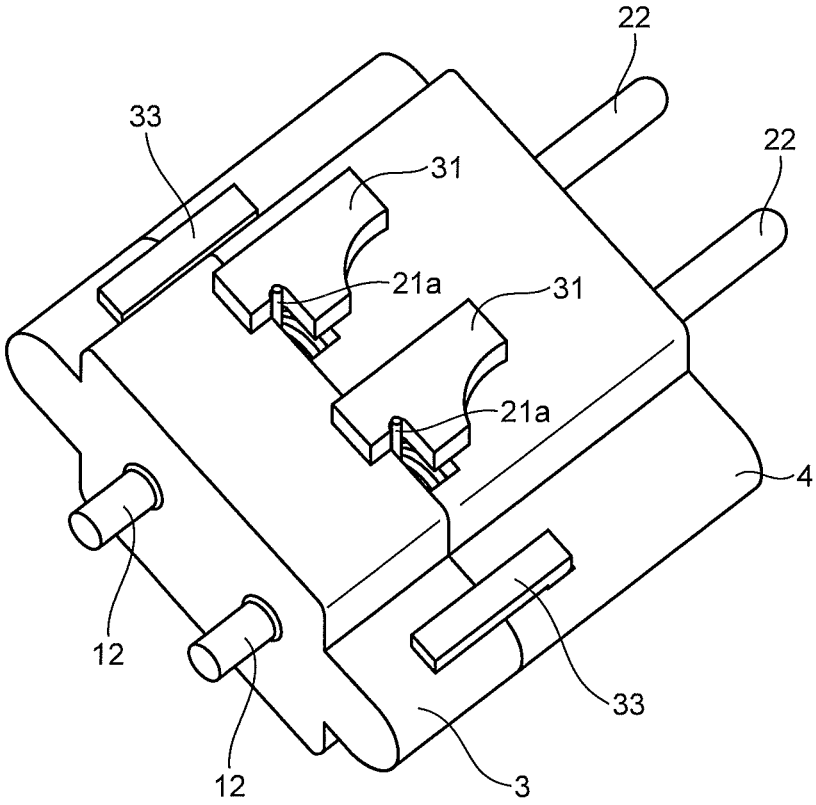
FIG. 10 is a perspective view illustrating a state in which a male terminal bracket and a female terminal bracket illustrated in FIG. 8 are in contact with each other.

FIG. 10 is a perspective view illustrating a state in which the male terminal bracket 3 and the female terminal bracket 4 illustrated in FIG. 8 are in contact with each other. By inserting the guide pins 32 into the guide holes 42 illustrated in FIG. 8, a proximity position of the male terminal bracket 3 with respect to the female terminal bracket 4 is determined, and, the male terminals 11 are inserted into the coil springs 21 along with the insertion of the guide pins 32 into the guide holes 42. In this case, along with the insertion of the male terminals 11 into the coil springs 21, the diameter expanding cams 31 expand the inner diameters of the coil springs 21 so that the male terminals 11 can be inserted into the coil springs 21, which will be explained below.

At the same time the male terminals 11 and the coil springs 21 are fitted to each other and the male terminal bracket 3 and the female terminal bracket 4 come into contact with each other, the projections of the lock bars 33 are engaged with the recesses of the lock holes 43.

As for the extending portions 21*a* of the coil springs 21, as illustrated in FIG. 10, when a force is applied in a direction in which the male terminal bracket 3 and the female terminal bracket 4 are separated from each other, because the extending portions 21*a* are in contact with the wall surfaces of the diameter expanding cams 31, the connector according to the second embodiment enables the locking by the coil springs 21 tightening the male terminals 11 as well as the locking effect by the extending portions 21*a* and the diameter expanding cams 31 in the connector.

Figure 11:
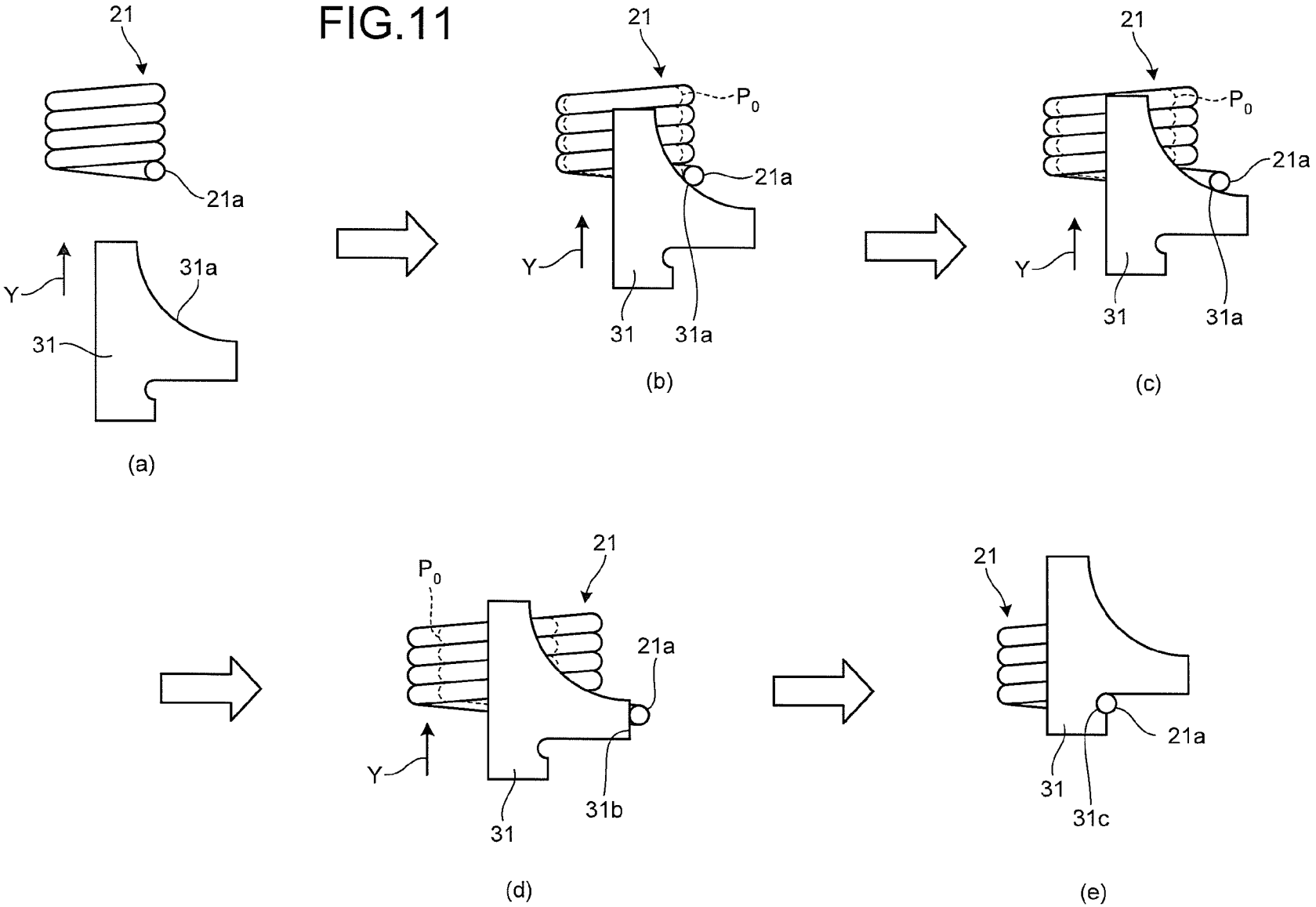
FIG. 11 is a plan view illustrating operations of a spring and a diameter expanding cam according to the second embodiment of the present invention.

FIG. 11 is a plan view illustrating operations of the spring and the diameter expanding cam according to the second embodiment. When the male terminal bracket 3 and the female terminal bracket 4 are fitted to each other, as illustrated in FIG. 11(*a*), the male terminal bracket 3 moves in a direction of arrow Y and the diameter expanding cam 31 approaches the coil spring 21. Then, the extending portion 21*a* comes into contact with a curved portion 31*a* of the diameter expanding cam 31.

After the extending portion 21*a* comes into contact with the curved portion 31*a*, the diameter expanding cam 31 further moves in the direction of arrow Y along with the movement of the male terminal bracket 3 or the female terminal bracket 4 (FIGS. 11(*b*) and (*c*)). In this case, the extending portion 21*a* moves in a circumferential direction of the coil spring 21 along the wall surface of the curved portion 31*a* of the diameter expanding cam 31, thereby expanding the inner diameter of the coil spring 21 as illustrated in FIG. 3B. Along with the expansion of the diameter, the male terminal 11 is inserted into the coil spring 21. Dashed lines $P_0$ indicate the position of the coil spring 21 in the natural state illustrated in FIG. 11(*a*). In the second embodiment, when the extending portion 21*a* moves to the position indicated in FIG. 11(*b*), the expanded inner diameter of the coil spring 21 becomes equal to or greater than the diameter of the male terminal 11. A timing at which the diameter of the coil spring 21 is expanded is adjusted according to the positional relation between the diameter expanding cam 31 and the male terminal 11.

When the diameter expanding cam 31 further moves in the direction of arrow Y, the extending portion 21*a* comes into contact with a linear portion 31*b* (FIG. 11(*d*)). The inner diameter of the extending portion 21*a* is most expanded when the extending portion 21*a* is in contact with the linear portion 31*b*.

Thereafter, when the male terminal bracket 3 and the female terminal bracket 4 come into contact with and fitted to each other, the extending portion 21*a* moves along the notch surface in a direction orthogonal to the moving direction of the diameter expanding cam 31 and is held by a groove 31*c* (FIG. 11(*e*)). In this case, a force in a direction in which the inner diameter of the coil spring 21 is expanded is not applied to the extending portion 21*a* held by the groove 31*c*, so that the extending portion 21*a* is held by a force that maintains the contact with the wall surface. The groove 31*c* may be prevented from coming into contact with the extending portion 21*a*.

In the connector according to the second embodiment described above, the diameter expanding cam 31 expands the inner diameter of the coil spring 21 along with insertion of the male terminal 11 into the coil spring 21. Therefore, it becomes possible to expand the inner diameter of the coil spring 21 by the extending portion 21*a* and insert the male terminal 11 into the coil spring 21 without manually operating the extending portion 21*a*. Furthermore, it is advantageous in that the guide pin 32 functions to determine the position of the male terminal 11 to be inserted into the coil spring 21, and it is possible to prevent deviation of the insertion position of the male terminal due to the force applied by the diameter expanding cam 31 to the extending portion 21*a*.

Figure 12:
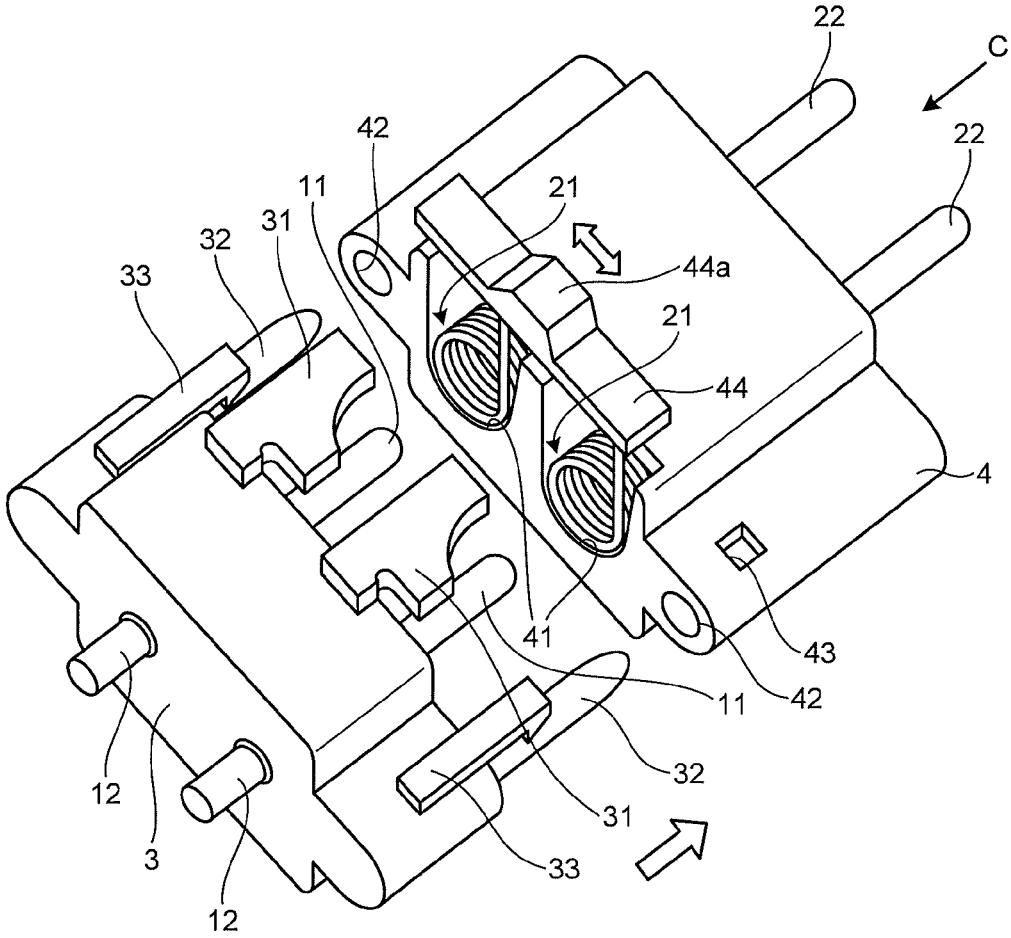
FIG. 12 is a perspective view illustrating a connector according to a modification of the second embodiment of the present invention.
Figure 13:
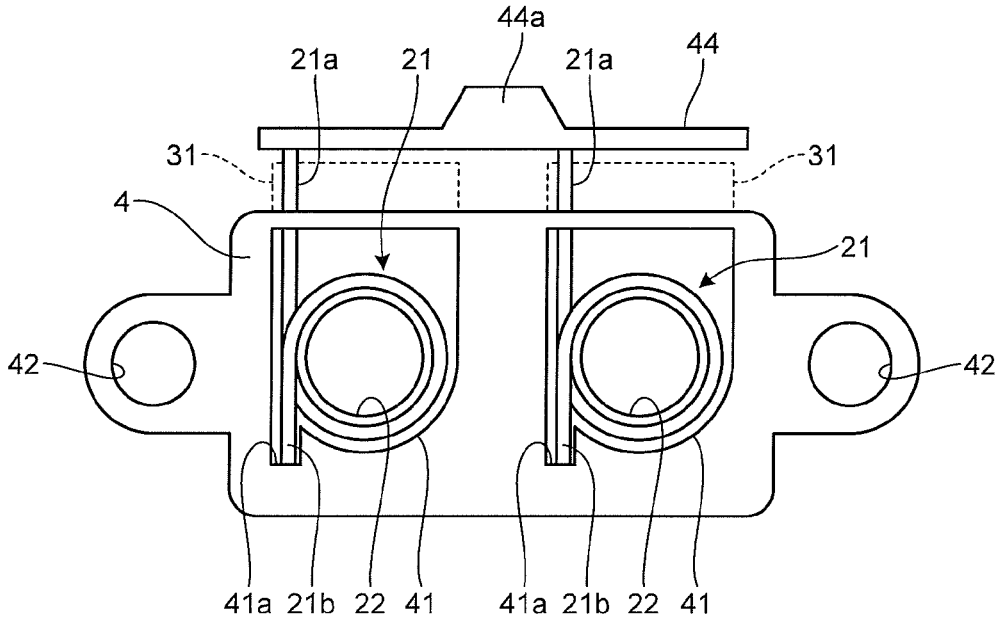
FIG. 13 is a plan view of the connector illustrated in FIG. 12 viewed in a direction of arrow C.

FIG. 12 is a perspective view illustrating a connector according to a modification of the second embodiment. FIG. 13 is a plan view of the connector illustrated in FIG. 12 viewed in a direction of arrow C. The connector according to the modification includes, in addition to the components of the connector according to the second embodiment described above, a knob 44 as a diameter changing means that is slidable in the circumferential direction of the coil springs 21 and that expands or reduces the inner diameters of the coil springs 21 by moving the extending portions 21*a* on the plane orthogonal to the longitudinal direction of the coil springs 21.

As illustrated in FIG. 13, the knob 44 forms a space parallel to the extending direction of the coil springs 21 between itself and the upper surface of the female terminal bracket 4, and the diameter expanding cams 31 are inserted into this space. Besides, the knob 44 can hold the extending portions 21*a* of the coil springs 21 and slide along with the movement of the extending portions 21*a*.

The diameter expanding cams 31 are inserted into the inner space of the knob 44 when the male terminal bracket 3 and the female terminal bracket 4 approach each other, and move the extending portions 21*a* by the operations illustrated in FIG. 11 to thereby expand the inner diameters of the coil springs 21.

When the male terminal bracket 3 and the female terminal bracket 4 are released from the fitted state, the knob 44 is caused to slide in the circumferential direction of the coil springs 21, so that the extending portions 21*a* that have been in contact with the diameter expanding cams 31 can easily be detached. If a protrusion 44*a* is provided, it becomes possible to more easily slide the knob 44.

In the second embodiment described above, it is explained that the two connectors each including the male terminal and the female terminal are provided. However, the number of the connectors may be one or three or more according to the leads (wiring) to be used.

INDUSTRIAL APPLICABILITY

As described above, the connector according to the present invention is useful for connecting electronic members to establish electrical continuity.

REFERENCE SIGNS LIST

1, 1*a*, 1*b* CONNECTOR
3 MALE TERMINAL BRACKET
4 FEMALE TERMINAL BRACKET
11 MALE TERMINAL
11*a* TIP PORTION
11*b*, 22*a*, 22*b* LEAD TERMINAL
12, 22 LEAD
21, 24, 25 COIL SPRING
21*a* EXTENDING PORTION
21*b* FIXATION PORTION
23 SUPPORT
31 DIAMETER EXPANDING CAM
32 GUIDE PIN

33 LOCK BAR
41 HOUSING
41*a* HOLDING PORTION
42 GUIDE HOLE
43 LOCK HOLE
44 KNOB

The invention claimed is:

1. A connector that is interposed between two connection objects to enable electrical continuity between the connection objects, the connector comprising:

a male terminal which has a conductive property and a tip of which is formed in a bar shape;

a female terminal formed of a conductive wire rod that is wound with an inner diameter smaller than a diameter of the male terminal, the wire rod linearly extending at an end portion of the female terminal at which the male terminal is to be inserted;

a male terminal bracket that holds the male terminal; and a female terminal bracket that holds the female terminal and that is connectable to the male terminal bracket, wherein the male terminal is inserted into the female terminal while a force that expands an inner diameter of at least a vicinity of the end portion is applied to the linearly extending portion, and thereafter fitted to the female terminal by releasing the force, and wherein the male terminal bracket includes a diameter expanding unit that expands a diameter of at least the linearly extending portion of the female terminal along with insertion of the male terminal into the female terminal.

2. The connector according to claim 1, wherein at least a vicinity of another end portion of the female terminal is tightly wound.

3. The connector according to claim 1, wherein an end portion of the female terminal, the end portion being different from the linearly extending portion, is fixed to the female terminal bracket.

4. The connector according to claim 3, wherein the female terminal bracket includes a diameter changing unit that holds the linearly extending portion of the female terminal and moves the linearly extending portion on a plane orthogonal to a longitudinal direction of the female terminal to thereby expand the diameter of the female terminal.

5. The connector according to claim 1, wherein the male terminal bracket includes a guide pin that extends parallel to the male terminal and that protrudes from a tip of the male terminal in an extending direction, and the female terminal bracket includes a hole in which the guide pin is insertable.

* * * * *